US005623118A

United States Patent [19]

Jackson

[11] Patent Number: 5,623,118

[45] Date of Patent: Apr. 22, 1997

[54] SHOT SHELL WAD

[75] Inventor: John W. Jackson, Arvada, Colo.

[73] Assignee: Windjammer Tournament Wads, Inc., Englewood, Colo.

[21] Appl. No.: 609,343

[22] Filed: Mar. 1, 1996

[51] Int. Cl.[6] ..... F42B 7/08

[52] U.S. Cl. ..... 102/451

[58] Field of Search ..... 102/439, 448–463, 102/520–523, 532

[56] References Cited

U.S. PATENT DOCUMENTS

| | | | |
|---|---|---|---|
| 3,394,654 | 7/1968 | Hayashi | 102/450 |
| 3,402,664 | 9/1968 | Cramer | 102/451 |
| 4,043,267 | 8/1977 | Hayashi | 102/439 |
| 4,151,799 | 5/1979 | Jackson | 102/451 |
| 4,295,426 | 10/1981 | Genco et al. | 102/451 |
| 4,635,555 | 1/1987 | Ferri . | |
| 5,361,701 | 11/1994 | Stevens . | |
| 5,413,050 | 5/1995 | Maki . | |

FOREIGN PATENT DOCUMENTS

| | | | |
|---|---|---|---|
| 2370258 | 7/1978 | France | 102/532 |

OTHER PUBLICATIONS

Lyman, *Shotshell Reloading Handbook*, 4th Ed. (1995), pp. 60–65.

*Primary Examiner*—Harold J. Tudor
*Attorney, Agent, or Firm*—Klaas, Law, O'Meara & Malkin, P.C.

[57] ABSTRACT

A shot shell wad may comprise a powder cup and a shot cup connected by first and second shot cup support members positioned in spaced apart relation. Both the first and second shot cup support members include deformable leg sections. A stabilizing member having a proximal end and a distal end is positioned between the first shot cup support member and the second shot cup support member. The proximal end of the stabilizing member is connected to the powder cup and the distal end of the stabilizing member is connected to the first and second shot cup support members by respective first and second transverse members.

17 Claims, 3 Drawing Sheets

SHOT SHELL WAD

FIELD OF INVENTION

This invention relates to shotgun cartridges in general and more specifically to shot shell wads having collapsible leg sections.

BACKGROUND

Shot shell wads are used in shot shell cases to separate the powder or propellent charge from the shot charge and to provide a seal for the hot expanding gases produced by the burning propellent. Many early shot shell wads were made of a heavy, cardboard-like material and were installed in the shell directly over the powder charge. Such cardboard over-powder wads or card wads, stood up well to the heat of the burning propellent charge and provided a fair seal between the hot expanding gases of the burning propellent and the shot or pellet charge. Such card wads were often used in conjunction with filler wads placed between the card wad and the shot charge. The filler wads, made from a relatively soft material, such as fiber, pressed paper, or cork, absorbed the initial pressure surges caused by the rapidly expanding gases of the burning propellent. Consequently, the filler wads tended to "soften the blow" on the relatively soft lead pellets comprising the shot charge, thus reducing pellet deformation and improving their subsequent trajectory.

While such card over-powder wads and filler wads were used for a number of years, they were not without their disadvantages. For example, the inside wall of the shell case needed to be perfectly smooth and straight, otherwise leaks would develop between the burning propellent and shot, thereby reducing the muzzle velocity of the shot charge and causing other problems. Such wads also did nothing to protect the relatively soft lead pellets from contacting the inside wall of the barrel. Not only does direct contact with the barrel tend to deform the pellets, thus adversely affect the trajectory of the shot charge, it also increases barrel wear.

Another type of wad more recently developed is the plastic over-powder cup wad. While many different kinds of plastic over-powder cup wads exist and are being used, almost all include a powder cup, a collapsible mid-section, and a shot cup. The powder cup typically incorporates an obturating lip seal which provides for improved sealing under almost all conditions, especially with shell casings having tapered walls. The shot cup generally includes a plurality of thin plastic panels or petals that surround the pellets of the shot charge. The petals prevent the pellets from contacting the barrel of the gun during firing.

While such plastic over-powder cup wads are generally superior to the older style card and fiber wads and are used almost exclusively, they are still not without their drawbacks. For example, while the mid sections of many wads are intended to be collapsible, they often do not collapse by an amount sufficient to provide a significant cushion for the shot pellets. Consequently, such wads may cause significant pellet deformation with an attendant loss of ballistic consistency. Even if the collapsible mid-sections do provide sufficient cushioning, the deformation or collapse is not always uniform, which may subject the relatively soft pellets to rapidly changing acceleration loads, causing them to deform. Other types of collapsible mid-sections may collapse more on one side than the other, thus imposing side forces on the shot cup as the wad and shot charge travel down the barrel. Such side forces may cause the pellets to shift as they travel down the barrel, thus resulting in an asymmetrical shot charge and, of course, unpredictable pellet trajectories.

Another problem associated with plastic over-powder cup wads is that they can usually only be used with a specific shell and shot load. For example, a wad designed for use in a 12 gauge shell with a 1 oz. shot load usually cannot be used with a heavier shot load, such as a 1⅛ oz. shot load. If such a heaver load is used, the collapsible mid section may be excessively deformed during loading and may not apply the proper pressure on the propellent charge. Consequently, a shot shell manufacturer or a shot shell re-loader must have on hand several different wads in order to produce shot shells with different shot loads.

Consequently, a need exists for a shot shell wad having an improved collapsible mid-section that can provide for more uniform deformation to avoid subjecting the shot charge to excessive or variable acceleration forces which may cause the pellets to deform and/or shift as they are accelerated down the barrel. Ideally, such a shot shell wad should be lightweight to reduce the mass that must be accelerated down the barrel. Additional advantages could be realized if such an improved shot shell wad could be used with different shot charges.

SUMMARY OF THE INVENTION

A shot shell wad according to the present invention may comprise a powder cup and a shot cup connected by first and second shot cup support members positioned in spaced apart relation. Both the first and second shot cup support members include deformable leg sections. A stabilizing member having a proximal end and a distal end is positioned between the first shot cup support member and the second shot cup support member. The proximal end of the stabilizing member is connected to the powder cup, whereas the distal end is connected to the first and second shot cup support members by respective first and second transverse members.

Another embodiment of the shot shell wad includes a pair of breakable cross members connecting the proximal end of the stabilizing member to the first and second shot cup support members to allow heavier shot loads to be accommodated by the shot shell wad.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
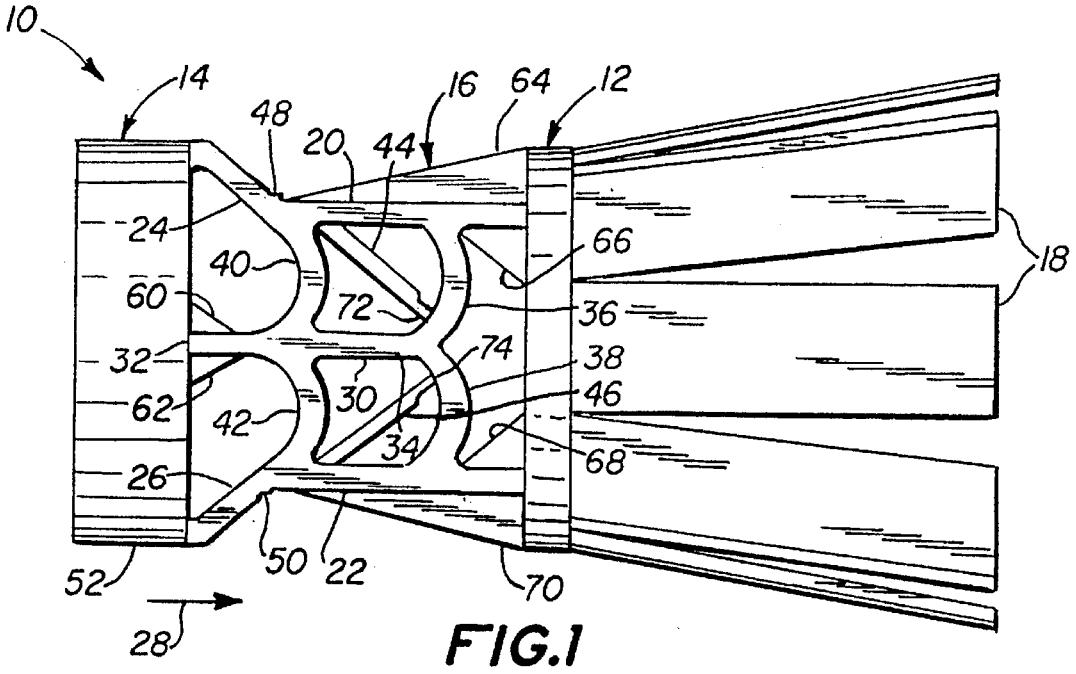
FIG. 1 is a front view in elevation of the improved shot shell wad according to the present invention showing the details of the shot cup support members, the stabilizing member, and the breakable cross members.
Figure 4:
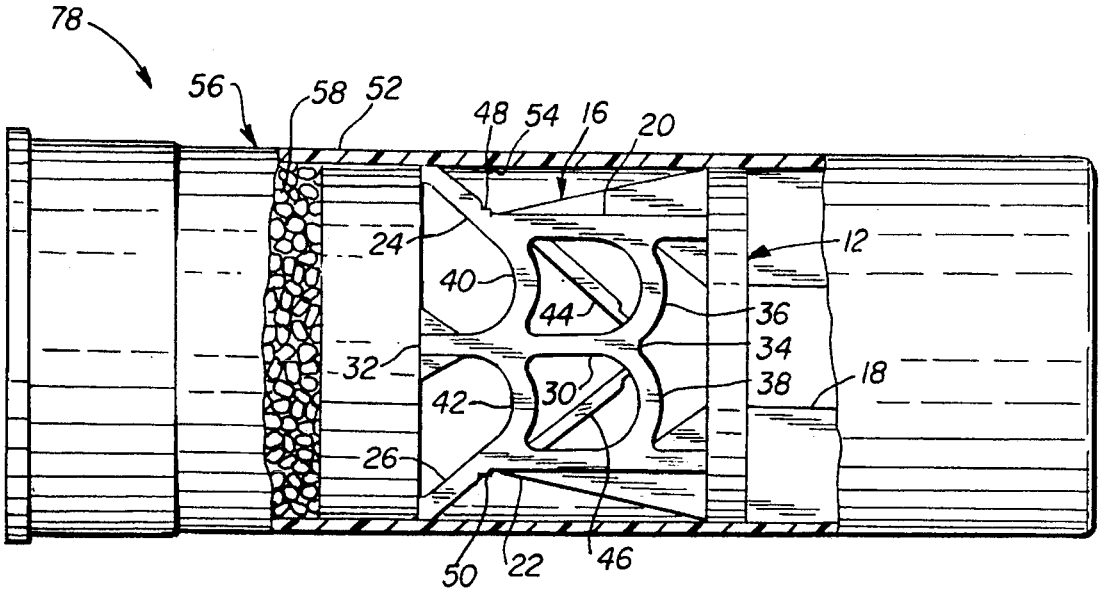
FIG. 4 is a front view in elevation of a 1 oz. load shot shell with a portion of the shot shell broken away to show the position of the shot shell wad.

An improved shot shell wad 10 according to the present invention is best seen in FIG. 1 and may comprise a shot cup 12 mounted to a powder cup 14 by a collapsible section 16. In one preferred embodiment, the shot cup 12 may include a plurality of petals 18 to protect the shot (not shown) from direct contact with the barrel of a gun (also not shown). The powder cup 14 may also include an obturating lip 52 to ensure a tight seal between the wad 10 and the inside wall 54 of the shell case 56 (FIG. 4).

The collapsible section 16 may include a first shot shell support member 20 having a deformable hinged leg 24 and a second shot shell support member 22 having a deformable hinged leg 26. The deformable hinged legs 24, 26 of the respective first and second shot shell support members 20 and 22 allow the powder cup 14 to move toward the shot cup 12 in the direction indicated by arrow 28. The collapsible section 16 may also include an elongate stabilizing member 30 positioned substantially between the first and second shot cup support members 20 and 22. The proximal end 32 of stabilizing member 30 is attached to the powder cup 14 while the distal end 34 is connected to the first and second shot cup support members 20 and 22 by respective transverse members or arches 36 and 38 having their respective convex sides oriented toward the shot cup 12. In one preferred embodiment, the stabilizing member 30 may also include third and fourth transverse members or arches 40 and 42 connected to the first and second shot cup support members 20 and 22, respectively. Arches 40 and 42 are also positioned so that their convex sides are oriented toward the shot cup 12. A pair of cross members 44 and 46 allow the improved shot shell wad 10 to accommodate various sized shot loads, as will be described in greater detail below. In one preferred embodiment, the improved shot shell wad 10 according to the present invention is molded as a single, unitary piece from polyethylene plastic, although other materials could be used.

The stabilizing member 30 stabilizes the first and second shot cup support members 20 and 22 when the collapsible section 16 is collapsed, i.e., when the powder cup 14 moves toward the shot cup 12 in the direction of arrow 28, such as may occur during loading and certainly during firing. The stabilizing member 30 also ensures that the deformable hinged legs 24, 26 of the respective first and second shot cup support members 20 and 22 collapse or deform by substantially equal amounts, thereby preventing the collapsible section 16 from imposing asymmetrical loads (i.e., side forces) on the shot cup 12.

Figure 3:
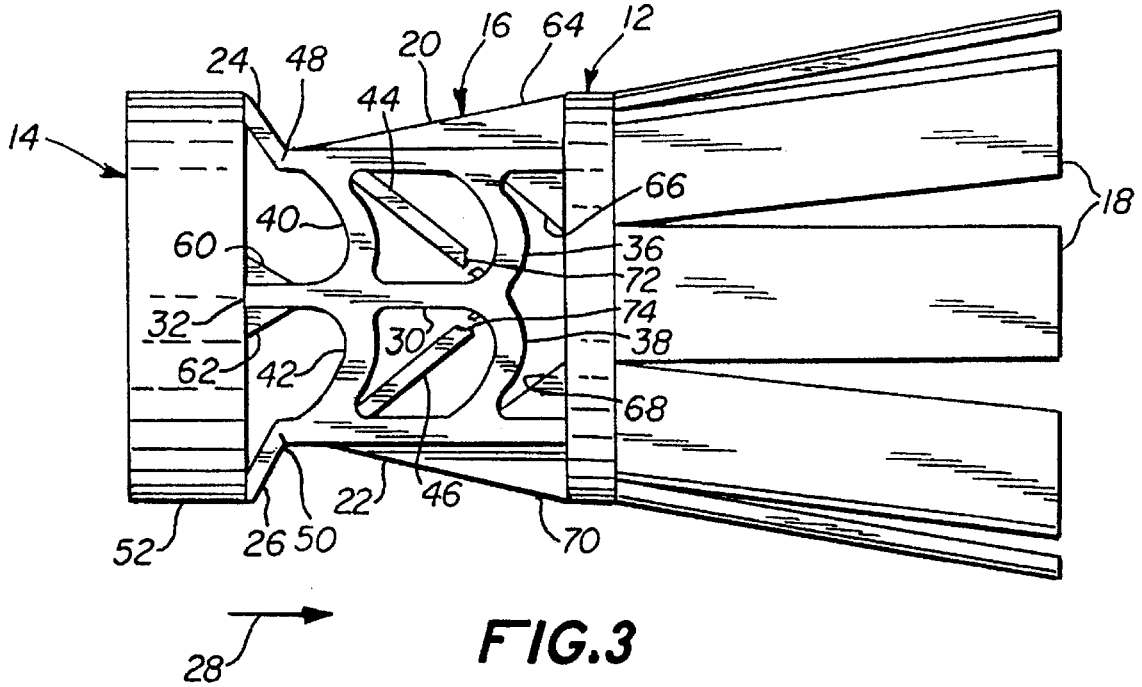
FIG. 3 is a front view in elevation of the shot shell wad shown in FIG. 1, but showing the partial compression of the collapsible mid-section.

During deformation or collapse, that is, as the powder cup 14 moves toward the shot cup 12 in the direction of arrow 28 or vice-versa, the deformable hinged legs 24 and 26 deform or bend at their respective hinge lines 48 and 50, thus decreasing the overall lengths of the first and second shot cup support members. As this deformation occurs, the elongate support member 30 moves toward the shot cup 12 in the direction of arrow 28, deforming the transverse or arched members 36, 38, 40, and 42, to absorb energy and cushion the shot load. The transverse or arched members 36, 38, 40, and 42 also stabilize the collapse or deformation of the first and second shot cup support members 20 and 22, as best seen in FIG. 3.

A significant advantage of the improved shot shell wad 10 according to present invention is that the collapsible section 16 provides for a more uniform collapse during firing. The uniform collapse slows the burn rate of the propellent, thus improving the efficiency of combustion and allowing higher muzzle velocities to be attained with lower burning pressures. Another advantage is that the pellets in the shot charge are subjected to less variation in acceleration, thus decreasing the amount of deformation suffered by the pellets during firing. Yet another advantage is that the stabilizing member 30 allows for the substantially equal collapse or deformation of the first and second shot shell support members 20 and 22, thus preventing asymmetrical or side forces from being imposed on the shot cup 12.

Still other advantages are associated with the breakable cross members 44 and 46. For example, the breakable cross members 44 and 46 allow the shot shell wad 10 to accommodate different shot loads. That is, in the embodiment shown and described in FIGS. 4 and 5, the same shot shell wad 10 can accommodate both 1 oz. shot loads as well as 1⅛ oz. shot loads. In the case of the heavier 1⅛ oz. load, the cross members 44, 46 part or break during the loading process, thus allowing the increased shot load to be accommodated in the same sized shell case 56 while preventing excessive pressure from being exerted on the propellent 58.

Figure 2:
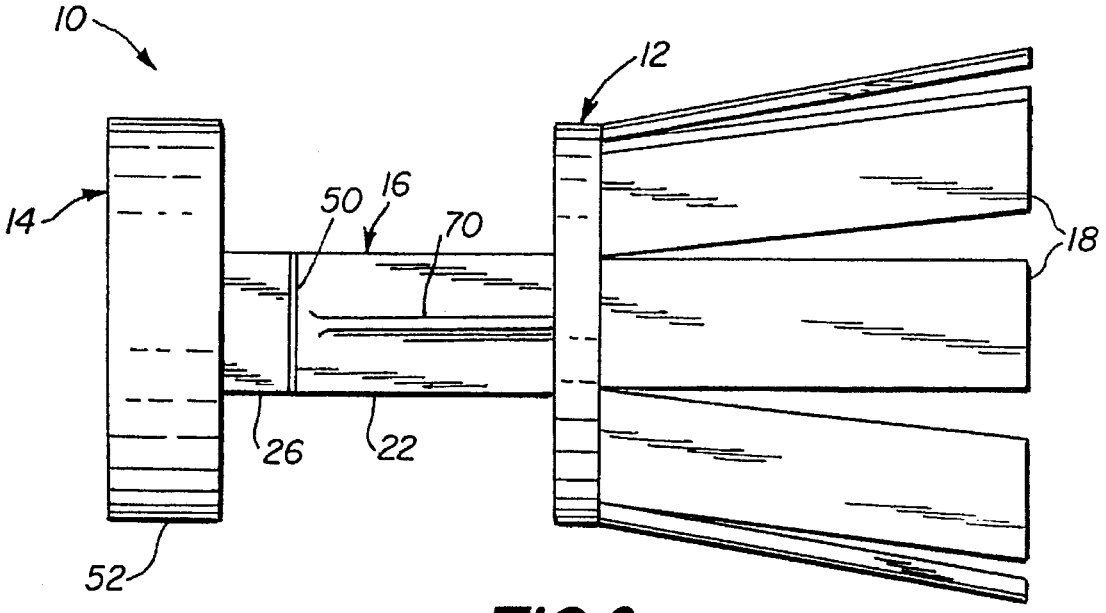
FIG. 2 is a side view in elevation of the shot shell wad shown in FIG. 1.

Having briefly described the improved shot shell wad 10 according to the present invention, as well as some of its more significant features and advantages, the shot shell wad 10 will now be described in detail. Referring now to FIGS. 1–3, with occasional reference to FIG. 4, the improved shot shell wad 10 may comprise a shot cup 12 mounted to a powder cup 14 by a collapsible section 16. The shot cup 12 is adapted to receive a plurality of shot pellets (not shown) of the kind commonly used for shot shells. Alternatively, the shot cup 12 may be filled with a single slug (not shown), also of the kind commonly used for shot shells. The shot cup 12 may also include a plurality of petals 18 that surround the pellets (not shown) contained within the shot cup 12 to prevent them from contacting the inside of the gun barrel as the shot pellets are accelerated along the length of the barrel.

The powder cup 14 is positioned against the propellent charge 58 contained within the shell case 56 in the conventional manner. See FIG. 4. It is preferred, but not required, that the powder cup 14 also include an obturating seal or lip 52 to ensure a positive seal between the wad 10 and the inside wall 54 of the shell case 56.

Referring back now to FIGS. 1–3, the collapsible section 16 may comprise a first shot cup support member 20 and a second shot cup support member 22. Each shot cup support member 20, 22 extends between the powder cup 14 and the shot cup 12 and includes a collapsible leg section. More specifically, the first shot cup support member 20 includes a collapsible or deformable hinged leg 24, whereas the second shot cup support member 22 includes a hinged leg 26. Each leg 24, 26 includes a respective hinge line 48, 50 having a reduced cross-sectional area which allows each leg 24, 26 to collapse or deform substantially along its respective hinge line 48, 50, as best seen in FIG. 3. The first and second shot cup support legs 20 and 22 may also include stabilizing gussets 64, 66, 68, and 70 for strengthening the joints between the support members 20 and 22 and the shot cup 12.

The collapsible section 16 also includes a stabilizing member 30 having its proximal end 32 attached directly to the powder cup 14. A pair of gusset members 60, 62 may also be included to reinforce the joint. The distal end 34 of stabilizing member 30 is connected to the first and second shot cup support members 20 and 22 by respective transverse members or arches 36 and 38. Transverse members or arches 36 and 38 are positioned so that their convex sides (i.e., the right side of each respective arch generally in the area of the lead line identifying each arch) are facing the shot cup 12, as best seen in FIG. 1. The transverse arches 36 and 38 provide a substantially uniform retarding force as they are deformed when the stabilizing member 30 moves toward the shot cup 12. See FIG. 3. The transverse arches 36 and 38 also apply substantially identical forces to the respective first and second shot cup support members 20 and 22, thus reducing the chances that asymmetrical or side loads will be imposed on the shot cup 12. In one preferred embodiment, the stabilizing member 30 may also be supported at about its mid section by third and fourth arched transverse members 40 and 42 that are connected to the first and second shot cup support members 20 and 22 in the manner shown in FIG. 1. The third and fourth arched transverse members 40 and 42 are also positioned so that the convex portion of each respective arch (i.e., the right side of each arch generally on the opposite side of the lead line identifying each arch) is facing the shot cup 12. The third and fourth arched transverse members 40 and 42 provide additional stability and retarding force.

A pair of breakable cross members 44 and 46 are connected between the proximal end 34 of stabilizing member 30 and the first and second shot cup support members 20 and 22, respectively. Cross members 44, 46 include respective parting joints 72, 74 having reduced cross sectional areas. The parting joints 72, 74 allow the cross members 44 and 46 to break if a heavier shot charge is loaded, as will be explained in greater detail below.

In one preferred embodiment, the shot shell wad 10 may be molded as a single piece from polyethylene plastic, which provides for a tough, yet resilient wad. However, other materials may also be used, as would be obvious to persons having ordinary skill in the art after having become familiar with the teachings of the present invention.

Figure 5:
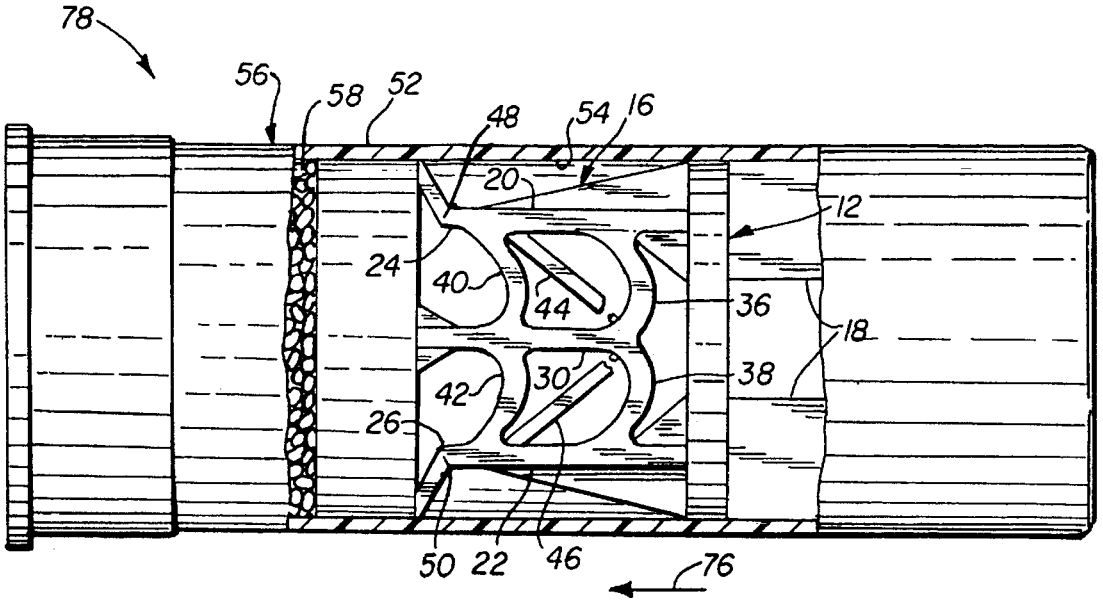
FIG. 5 is a front view in elevation of a 1⅛ oz. load shot shell with a portion of the shot shell broken away to show the position of the shot shell wad and the broken cross members.

The actual use of the improved shot shell wad 10 according to the present invention is best seen by referring to FIGS. 4 and 5. Referring now to FIG. 4, the shot shell wad 10 is shown as it could be used in a 12 gauge shot shell 78 with a 1 oz. shot load. Essentially, the shot shell 78 may comprise a conventional a shell case 56 filled with a suitable propellent 58. The improved shot shell wad 10 is then inserted into the shell case 56 so that the powder cup 14 is adjacent to the propellent 58. The shot cup 12 is then filled with a 1 oz. load of shot pellets (not shown). A conventional loading press (also not shown) may be used to assemble the shot shell in the conventional manner.

In the embodiment shown in FIG. 4, the shot shell wad 10 is specifically designed for the 12 gauge shell case 56 and to accommodate a 1 oz. shot load. Consequently, once the shell case 56 is loaded and crimped, the collapsible section 16 of wad 10 will be slightly compressed, but the cross members 44 and 46 will still be connected to the distal end 34 of stabilizing member 30.

If, however, it is desired to use the same wad 10 with a heavier shot load, say, for example, a 1⅛ oz. shot load, then the wad 10 would appear substantially as shown in FIG. 5. In this instance, the wad 10 is compressed to a greater degree than was the case for the 1 oz. load shown in FIG. 4. The greater compression is due to the fact that an extra row or two of shot pellets (not shown) must be accommodated within the shell case 56, which will cause the shot cup 12 to be displaced back toward the powder cup 14 in the direction indicated by arrow 76. This greater compression of the collapsible section 16 that occurs during shell loading imposes excessive tensile stress on the reduced cross-sectional area parting joints 72, 74, causing them to break. However, the wad 10 still places the proper amount of pressure on the propellent 58 due to the greater deflection of the resilient collapsible section 16.

Regardless of whether the shot load is 1 oz. load or 1⅛ oz. load, the collapsible section 16 of wad 10 will deform during firing quite uniformly and by a great degree, thus slowing the burn rate of the propellent 58 to ensure more complete combustion. The greater and more uniform collapse of collapsible section 16 also decreases the acceleration loads imposed on the shot charge. As the propellent 58 burns, the rapidly expanding high pressure combustion gas pushes the powder cup 14 forward toward the shot cup 12 in the direction of arrow 28 (FIG. 1). The pressure exerted on the powder cup 14 causes the legs 24 and 26 of the first and second shot cup support members 20 and 22 to collapse or pivot about their respective hinge lines 48 and 50. See FIG. 3. At the same time, the stabilizing member 30 moves toward the shot cup 12, deforming the transverse arch members 36, 38, 40, and 42 as it moves. While the transverse arch members 36, 38, 40, and 42 apply various forces and bending moments to the first and second support legs 20 and 22, those forces are substantially balanced by the symmetrical arrangement of the transverse arch members about the stabilizing member 30. Therefore, the compression of the collapsible section 16 does not impose significant side loads on the shot cup 12, thus providing for increased shot consistency.

This completes the detailed description of the preferred embodiments of the improved shot shell wad 10 according to the present invention. While a number of specific components were described above for the preferred embodiments of this invention, persons skilled in this art will readily recognize that other substitute components or combinations of components may be available now or in the future to accomplish comparable functions to the apparatus described herein. For example, the transverse arches 36, 38, 40, and 42 need not be circular in shape, but could instead comprise elliptical, parabolic, triangular, or any other type of convex structure, so long as the structure is convex with regard to the shot cup 12 in the manner shown and described herein. Alternatively, other kinds of plastic materials besides polyethylene could be used for the shot shell wad 10, so long such other plastics are capable of withstanding the expected temperatures and pressures to be encountered and will provide sufficient resiliency to allow the collapsible section 16 to deform in the manner described.

Consequently, it is contemplated that the inventive concepts herein described may be variously otherwise embodied and it is intended that the appended claims be construed to include alternative embodiments of the invention except insofar as limited by the prior art.

What is claimed is:

1. A shot shell wad, comprising:

a powder cup;

a shot cup;

a first shot cup support member extending between said powder cup and said shot cup, said first shot cup support member also having a deformable section;

a second shot cup support member positioned in spaced-apart relation from said first shot cup support member, said second shot cup support member also extending between said powder cup and said shot cup and also having a deformable section; and a stabilizing member having a proximal end and a distal end, said stabilizing member being positioned between said first shot cup support member and said second shot cup support member, the proximal end of said stabilizing member being connected to said powder cup;

a first arched transverse member connected between said first shot cup support member and the distal end of said stabilizing member, said first arched transverse member having a convex side oriented toward said shot cup; and a second arched transverse member connected between said second shot cup support member and the distal end of said stabilizing member, said second arched transverse member having a convex side oriented toward said shot cup.

2. The shot shell wad of claim 1, further comprising:

a third arched transverse member connected between said stabilizing member and said first shot cup support member, said third arched transverse member having a convex side oriented toward said shot cup; and a fourth arched transverse member connected between said stabilizing member and said second shot cup support member, said fourth arched transverse member having a convex side oriented toward said shot cup, said third and fourth arched transverse members being positioned between said first and second arched transverse members and said powder cup.

3. A shot shell wad comprising a powder cup connected to a shot cup by a first shot cup support member and a second shot cup support member mounted in spaced-apart relation, each of said first and second shot cup support members also having a deformable section, said shot shell wad also including a stabilizing member having a proximal end and a distal end, said stabilizing member being positioned between said first shot cup support member and said second shot cup support member so that the proximal end of said stabilizing member is connected to said powder cup and so that the distal end of said stabilizing member is connected to said first and second shot cup support members by respective first and second arched transverse members, said first and second arched transverse members having respective convex sides oriented toward said shot cup, said stabilizing member also including a third arched transverse member connected between said stabilizing member and said first shot cup support member and a fourth arched transverse member connected between said stabilizing member and said second shot cup support member, said third and fourth arched transverse members having respective convex sides oriented toward said shot cup, said third and fourth arched transverse members being positioned between said first and second arched transverse members and said powder cup.

4. A shot shell wad, comprising:

a powder cup;

a shot cup;

a first shot cup support member extending between said powder cup and said shot cup, said first shot cup support member also having a deformable section;

a second shot cup support member positioned in spaced-apart relation from said first shot cup support member, said second shot cup support member also extending between said powder cup and said shot cup and also having a deformable section:

a stabilizing member having a proximal end and a distal end, said stabilizing member being positioned between said first shot cup support member and said second shot cup support member, the proximal end of said stabilizing member being connected to said powder cup, the distal end of said stabilizing member being connected to said first and second shot cup support members by respective first and second transverse members, and wherein said stabilizing member also includes a third transverse member connected between said stabilizing member and said first shot cup support member and a fourth transverse member connected between said stabilizing member and said second shot cup support member, said third and fourth transverse members being positioned between said first and second transverse members and said powder cup;

a first cross member mounted between said stabilizing member and said first shot cup support member, one end of said first cross member being connected to said stabilizing member at about the distal end of said stabilizing member, another end of said first cross member being connected to said first shot cup support member at about a juncture between said third transverse member and said first shot cup support member; and a second cross member mounted between said stabilizing member and said second shot cup support member, one end of said second cross member being connected to said stabilizing member at about the distal end of said stabilizing member, another end of said second cross member being connected to said second shot cup support member at about a juncture between said fourth transverse member and said second shot cup support member.

5. The shot shell wad of claim 4, wherein said first and second transverse members comprise arches.

6. The shot shell wad of claim 5, wherein said third and forth transverse members comprise arches.

7. The shot shell wad of claim 6, wherein each of said first and second cross members include a breakable section, wherein said breakable section of each of said first and second cross members breaks when said power cup moves toward said shot cup.

8. The shot shell wad of claim 7, wherein the deformable sections of said first and second shot cup support members include respective hinged portions, the hinged portions of the respective deformable sections of said first and second shot cup support members allowing said powder cup to move toward said shot cup.

9. The shot shell wad of claim 8, further comprising:

a first gusset mounted to said first shot cup support member and said shot cup;

a second gusset mounted to said second shot cup support member and said shot cup.

10. The shot shell wad of claim 9, wherein said shot shell wad is molded as a single piece from a plastic material.

11. The shot shell wad of claim 10, wherein said plastic material comprises a polyethylene plastic.

12. A shot shell wad, comprising:

a powder cup connected to a shot cup by a first shot cup support member and a second shot cup support member mounted in spaced-apart relation, each of said first and second shot cup support members also having a deformable section, said shot shell wad also including stabilizing member having a proximal end and a distal end, said stabilizing member being positioned between said first shot cup support member and said second shot cup support member so that the proximal end of said stabilizing member is connected to said powder cup and so that the distal end of said stabilizing member is connected to said first and second shot cup support members by respective first and second transverse members, said stabilizing member also including third transverse member connected between said stabilizing member and said first shot cup support member and a fourth transverse member connected between said stabilizing member and said second shot cup support member, said third and fourth transverse members being positioned between said first and second transverse members and said powder cup;

a first cross member mounted between said stabilizing member and said first shot cup support member, one end of said first cross member being connected to said stabilizing member at about the distal end of said stabilizing member, another end of said first cross member being connected to said first shot cup support member at about a juncture between said third transverse member and said first shot cup support member; and a second cross member mounted between said stabilizing member and said second shot cup support member, one end of said second cross member being connected to said stabilizing member at about the distal end of said stabilizing member, another end of said second cross member being connected to said second shot cup support member at about a juncture between said fourth transverse member and said second shot cup support member.

13. The shot shell wad of claim 12, wherein said first and second transverse members comprise arches.

14. The shot shell wad of claim 13, wherein said third and forth transverse members comprise arches.

15. The shot shell wad of claim 14, wherein said arches that comprise said first, second, third, and fourth transverse members include a convex side, the convex side of each of said arches being oriented toward said shot cup.

16. The shot shell wad of claim 14, wherein each of said first and second cross members include a breakable section, wherein said breakable section of each of said first and second cross members breaks when said power cup moves toward said shot cup by a predetermined distance.

17. The shot shell wad of claim 14, wherein the deformable sections of said first and second shot cup support members include respective hinged portions, the hinged portions of the respective deformable sections of said first and second shot cup support members allowing said powder cup to move toward said shot cup.

* * * * *